US007568426B2

(12) United States Patent
Koppelkamm

(10) Patent No.: US 7,568,426 B2
(45) Date of Patent: Aug. 4, 2009

(54) PRINTING UNIT AND INKING UNIT

(75) Inventor: Günter Koppelkamm, Neuensalz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 354 days.

(21) Appl. No.: 11/206,684

(22) Filed: Aug. 18, 2005

(65) Prior Publication Data

US 2006/0037504 A1 Feb. 23, 2006

(30) Foreign Application Priority Data

Aug. 19, 2004 (DE) ..... 10 2004 040 150

(51) Int. Cl.
*B41F 31/00* (2006.01)
*B41L 23/00* (2006.01)

(52) U.S. Cl. ..... 101/350.2; 101/148; 101/216

(58) Field of Classification Search ..... 101/147, 101/148, 216, 350.1, 350.2, 350.3, 352.06
See application file for complete search history.

(56) References Cited

U.S. PATENT DOCUMENTS

| | | | | |
|---|---|---|---|---|
| 3,467,008 | A * | 9/1969 | Domotor | 101/142 |
| 4,000,692 | A | 1/1977 | Wirz et al. | |
| 4,590,856 | A * | 5/1986 | Mamberer et al. | 101/350.1 |
| 5,375,522 | A * | 12/1994 | Junghans | 101/424 |
| 6,279,473 | B1 | 8/2001 | Schneider et al. | |
| 6,408,748 | B1 | 6/2002 | Hajek et al. | |
| 6,578,481 | B1 | 6/2003 | Beisel et al. | |
| 6,612,238 | B2 * | 9/2003 | Voge et al. | 101/365 |
| 6,644,184 | B1 | 11/2003 | Hajek et al. | |
| 6,776,093 | B2 | 8/2004 | Masuch | |
| 6,779,446 | B2 | 8/2004 | Hajek et al. | |
| 6,892,635 | B2 | 5/2005 | Herbert | |
| 6,899,026 | B2 | 5/2005 | Weis | |
| 6,901,854 | B2 | 6/2005 | Masuch | |
| 6,915,739 | B2 | 7/2005 | Gerner | |
| 2003/0066444 | A1 | 4/2003 | Hajek et al. | |

(Continued)

FOREIGN PATENT DOCUMENTS

| | | |
|---|---|---|
| DE | 44 30 693 | 3/1996 |

(Continued)

OTHER PUBLICATIONS

German Search Report dated Mar. 16, 2005 for application No. 10 2004 040 150.0.

*Primary Examiner*—Ren Yan
(74) *Attorney, Agent, or Firm*—Cohen Pontani Lieberman & Pavane LLP

(57) ABSTRACT

A printing unit includes a press unit having a forme cylinder, a transfer cylinder, an inking unit and, preferably, a damping unit. The inking unit of each press unit applies printing ink to a forme cylinder of the respective press unit in such a way that a ductor roll of an inking unit picks up printing ink kept ready in an ink fountain and applies it to the forme cylinder of the respective press unit by a film roll interacting with the ductor roll, inking unit rolls arranged downstream of the film roll, and at least one ink applicator roll rolling on the forme cylinder. Inking unit rolls driven in rotation and inking unit rolls driven in oscillation are are driven independently from one another on the drive side.

2 Claims, 5 Drawing Sheets

U.S. PATENT DOCUMENTS

| | | | | |
|---|---|---|---|---|
| 2004/0074406 | A1 | 4/2004 | Gerner et al. | |
| 2004/0103803 | A1 | 6/2004 | Price et al. | |
| 2004/0107849 | A1 | 6/2004 | Christel et al. | |
| 2004/0144268 | A1 | 7/2004 | Christel et al. | |
| 2004/0177778 | A1 | 9/2004 | Christel et al. | |
| 2004/0231534 | A1 | 11/2004 | Christel et al. | |
| 2004/0231535 | A1 | 11/2004 | Gerner et al. | |
| 2004/0231536 | A1 | 11/2004 | Gerner et al. | |
| 2004/0244615 | A1 | 12/2004 | Herbert et al. | |
| 2004/0250717 | A1 | 12/2004 | Masuch et al. | |
| 2005/0016397 | A1* | 1/2005 | Masuch | 101/216 |
| 2005/0016399 | A1 | 1/2005 | Holm et al. | |
| 2005/0034615 | A1 | 2/2005 | Holm et al. | |

FOREIGN PATENT DOCUMENTS

| | | |
|---|---|---|
| DE | 195 20 841 | 12/1996 |
| DE | 101 58 487 | 8/2002 |
| DE | 101 63 961 | 7/2003 |
| DE | 101 63 962 | 7/2003 |
| EP | 1 068 955 | 1/2001 |
| WO | WO 98/51500 | 11/1998 |
| WO | WO 03/039872 | 5/2003 |

* cited by examiner

PRINTING UNIT AND INKING UNIT

BACKGROUND OF THE INVENTION

The invention relates to a printing unit having at least one press unit with at least one forme cylinder, a transfer cylinder, an inking unit, and a damping unit, the inking unit of each press unit applying printing ink to a forme cylinder of the respective press unit in such a way that a ductor roll of an inking unit picks up printing ink from an ink fountain, the printing ink being applied to the forme cylinder of the respective press unit by a film roll interacting with the ductor roll, by inking unit rolls arranged downstream of the film roll and by at least one ink applicator roll rolling on the forme cylinder. Furthermore, the invention relates to an inking unit for a press unit of a press applying printing ink to a forme cylinder of the press unit such that a ductor roll of an inking unit picks up printing ink from an ink fountain, the printing ink being applied to the forme cylinder of the press unit by a film roll interacting with the ductor roll, by inking unit rolls arranged downstream of the film roll and by at least one ink applicator roll rolling on the forme cylinder.

Printing units of web-fed rotary presses, in particular of newspaper presses, have a plurality of press units, each press unit comprising a transfer cylinder, a forme cylinder and an inking unit and also a damping unit. Oil-less press units without a damping unit are also known. Moreover, such press units may have impression cylinders, an impression cylinder being able to interact with one or more transfer cylinders of different press units. In addition to press units which have impression cylinders of this type, press units are also known which have no impression cylinder, the transfer cylinders of two press units rolling on each other in the case of such printing units without impression cylinders. As a rule, rubber blankets are stretched onto the transfer cylinders and printing plates are clamped onto the forme cylinders, for which reason the transfer cylinders are also designated blanket cylinders and the forme cylinders are also designated printing plate cylinders.

The inking unit of a press unit is used to apply printing ink to the forme cylinder of the press unit and the damping unit is used to apply a damping solution to the forme cylinder of the press unit. The prior art already discloses a series of inking units with which printing ink is applied effectively to a forme cylinder. As prior art, reference should be made here to U.S. Pat. No. 6,279,473 and DE 101 58 487 A1.

Inking units known from the prior art have a ductor roll, which picks up printing ink kept ready in an ink fountain of the inking unit and transfers it to a film roll. From the film roll, the printing ink is transported in toward the forme cylinder of the press unit by a plurality of inking unit rolls arranged downstream of the film roll. The inking unit rolls that roll on the forme cylinder are designated ink applicator rolls. In the inking units known from the prior art, at least some of the inking unit rolls arranged between the film roll and the or each ink applicator roll are driven so as to rotate and to oscillate at the same time. Because of the rotary drive, inking unit rolls rotate about their longitudinal central axis, and the same are moved to and fro along their longitudinal central axis in response to an oscillating drive. In the case of all the inking units known from the prior art, at least some of the inking unit rolls that are driven in rotation are also driven in oscillation. According to the prior art, all the inking unit rolls driven in oscillation are also driven in rotation. Because, the inking unit rolls driven in oscillation are also driven in rotation, the inking units and printing units and the associated drives require complex construction.

SUMMARY OF THE INVENTION

An object of the present invention is to provide a novel printing unit and a novel inking unit that overcomes the problems of the prior art.

The object is met by a printing unit having at least one press unit having at least one forme cylinder, a transfer cylinder, an inking unit and a damping unit. The inking unit of each press unit is arranged and dimensioned for applying printing ink to a forme cylinder of the respective press unit and includes a doctor roll picking up printing ink from an ink fountain, a film roll receiving ink from the ink doctor roll, and inking rolls including at least one ink applicator roll rolling on the forme cylinder arranged downstream of the film roll for applying ink from the film roll to the forme cylinder of the respective press unit. According to the present invention, inking unit rolls driven in rotation and inking unit rolls driven in oscillation within each inking unit are driven independently from one another. That is, they are separated on the drive side.

According to the present invention, a strict separation is maintained between inking unit rolls driven in oscillation and inking unit rolls driven in rotation within an inking unit. Therefore, the oscillating drive and rotary drive within an inking unit are accordingly separated or decoupled from each other. This has the advantage of a substantially simpler and therefore less expensive construction for an inking unit and a printing unit. The stroke during the oscillating movement may then be varied and set independently of the rotational speed of the rotary movement.

In addition, the rolls driven in rotation and rolls driven in oscillation are also separated from one another on the drive side within each damping unit of the press unit.

The object of the invention is also met by an inking unit for a press unit of a press, the inking unit including a doctor roll picking up printing ink from an ink fountain, a film roll receiving ink from the ink doctor roll, and inking rolls including at least one ink applicator roll rolling on the forme cylinder arranged downstream of the film roll for applying ink from the film roll to the forme cylinder of the respective press unit. According to the present invention, inking unit rolls driven in rotation and inking unit rolls driven in oscillation within each inking unit are separated from one another on the drive side.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
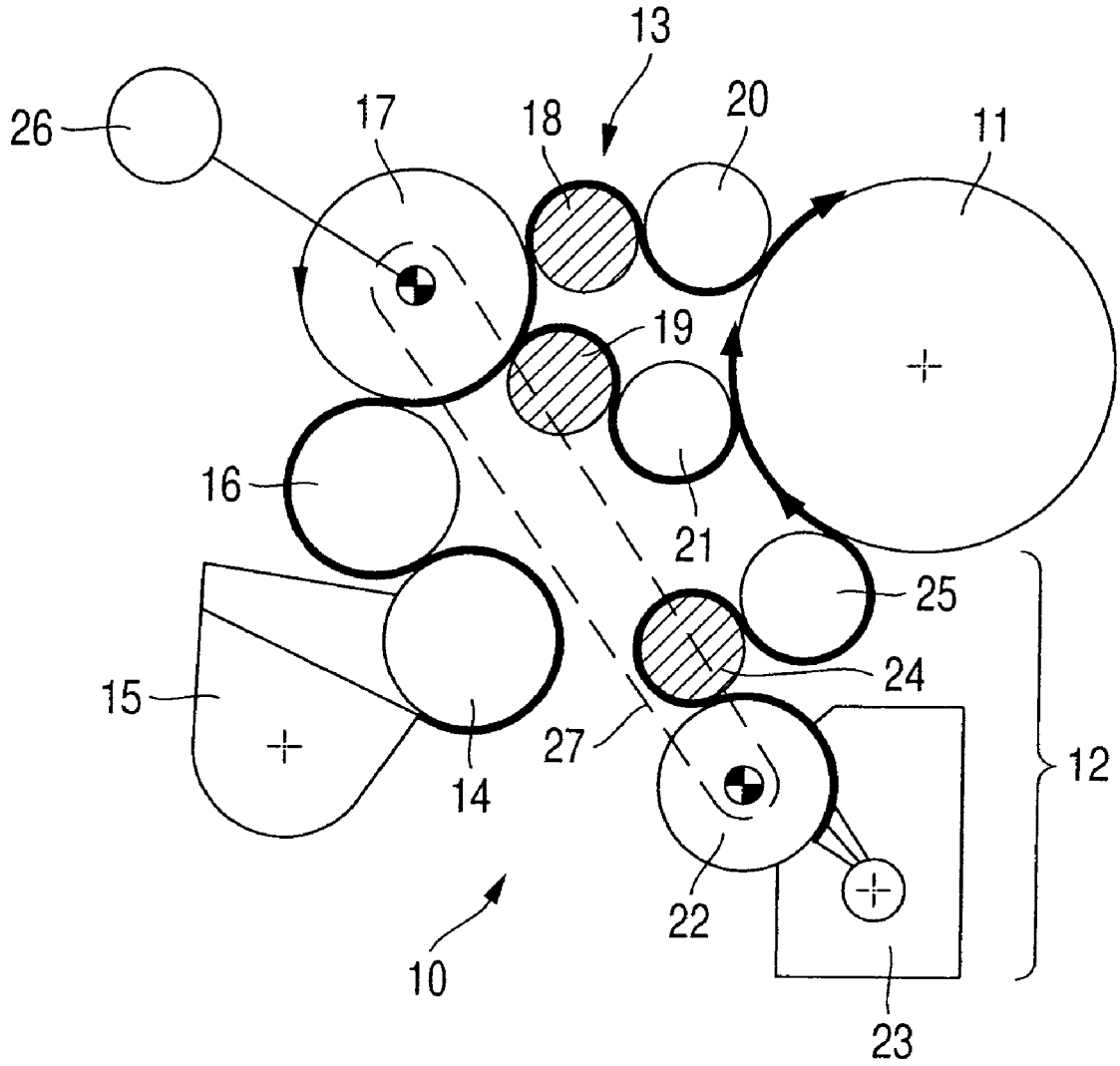
FIG. 1 is a schematic diagram of a region of a printing unit showing a press unit according to a first embodiment of the present invention.

A press unit 10 of a printing unit according to the present invention is shown in FIG. 1. The press unit 10 includes a forme cylinder 11, a damping unit 12 and an inking unit 13. The inking unit 13 has a ductor roll 14, which removes printing ink from an ink fountain 15 and transfers it to a film roll 16 interacting with the ductor roll 14. Starting from the film roll 16, the printing ink is transferred to the forme cylinder 11 by a plurality of inking unit rolls 17, 18 and 19 connected downstream of the film roll 16 and also by ink applicator rolls 20 and 21 rolling on the forme cylinder 11. The damping unit 12 of the press unit 10 in FIG. 1 comprises a chromium-coated or ceramic-coated roll 22, to which damping solution kept ready in a damping solution supply 23 is applied. The chromium-coated or ceramic-coated roll 22 transfers the damping solution to the forme cylinder 11 by two rolls 24 and 25 arranged downstream of the chromium-coated or ceramic-coated roll 22. The roll 25 rolls on the forme cylinder 11 and is accordingly also designated a damping solution applicator roll. By contrast, the roll 24 rolls on the chromium-coated or ceramic-coated roll 22.

According to the present invention, at least within the inking unit 13, the inking unit rolls driven in rotation and inking unit rolls driven in oscillation are separated from one another on the drive side. Rolls driven in rotation in the damping unit and rolls of the damping unit driven in oscillation are also separated from one another on the drive side. Thus, only rotary drives interact with the rolls driven in rotation and only axial drives interact with the rolls driven in oscillation. The separation of rotary drives and oscillating drives on different rolls is particularly advantageous in terms of construction and in terms of the process.

In FIG. 1—as seen from the ink fountain 15—the film roll 16 is arranged immediately downstream of an inking unit roll constructed as a central rubber-covered roll 17, the central rubber-covered roll 17 being driven in rotation via a rotary drive 26 assigned to the same. Likewise, the chromium-coated or ceramic-coated roll 22 of the damping unit 12 is driven in rotation, to be specific, starting from the central rubber-covered roll 17, by a chain drive 27 or a toothed belt connecting the central rubber-covered roll 17 and the chromium-coated or ceramic-coated roll 22. The chromium-coated or ceramic-coated roll 22 of the damping unit 12 is accordingly not assigned any separate rotary drive in the embodiment of FIG. 1. Instead, the chromium-coated or ceramic-coated roll 22 is driven in rotation by the rotary drive 26 assigned to the central rubber-covered roll 17 of the inking unit 13.

The inking unit rolls 18 and 19 which roll on the central rubber-covered roll 17 of the inking unit 13, the roll 24 rolling on the chromium-coated or ceramic-coated roll 22 of the damping unit 12, and also the ink applicator rolls 20 and 21 rolling on the forme cylinder 11 and the damping solution applicator roll 25 rolling on the same are driven by a frictional connection or friction, caused by the friction between the rolls and cylinders rolling on one another.

The rolls 18, 19 and 24 illustrated with hatched lines in FIG. 1 are rolls which effect oscillating movements. Thus, the inking unit rolls 18 and 19 and, in order to even out the damping solution film on the damping solution applicator roll 24, the roll 24 effect an oscillating movement in the axial direction. For this purpose, the rolls 18, 19 and 24 are assigned axial drives. It follows from this that, both in the inking unit 13 and in the damping unit 12 of the press unit 10 of FIG. 1, rolls driven in oscillation are driven independently of rolls driven in rotation.

In the exemplary embodiment of FIG. 1, starting from the central rubber-covered roll 17, the ink is applied to the forme cylinder 11 by two independent inking roll trains. A first inking roll train is formed by the inking unit roll 18 and the ink applicator roll 20, a second inking roll train is formed by the inking unit roll 19 and the ink applicator roll 21. A majority of the application of the printing ink to the forme cylinder 11 is effected by the inking roll train comprising the inking unit roll 19 and the ink applicator roll 21, that is to say by that ink applicator roll which directly follows the damping solution applicator roll 25 in the direction of rotation of the forme cylinder 11. Accordingly, the application of printing ink to the form cylinder 11 is preferably carried out by the ink applicator roll 21 facing the damping unit 12. Printing ink is also applied to the forme cylinder 11 by the ink applicator roll 20 of the other inking roll train, but the ink applicator roll 20 is also used for smoothing the ink film applied to the forme cylinder 11 by the ink applicator roll 21.

At this point, it should be pointed out that the film roll 16 is a relatively hard roll having a structured surface. The central rubber-covered roll 17 of the inking unit 13 is a relatively soft roll. The inking unit rolls 18 and 19 that oscillate are relatively hard and the ink applicator rolls 20 and 21 are relatively soft. In the damping unit 12, the chromium-coated or ceramic-coated roll 22 is a relatively hard roll, and the rolls 24 and 25 of the damping unit 12 are, by contrast, relatively soft. It follows directly from this that the rolls 18 and 19 of the inking unit 13 that effect an oscillating movement are relatively hard, the roll 24 of the damping unit 12 that carries out an oscillating movement is, by contrast, relatively soft.

Furthermore, it should be pointed out that axial drives for providing the oscillating movements of the rolls 18, 19 and 24 are preferably constructed as crankshaft drives with controlled-speed d.c. motors, which permit a change in the oscillation frequency and the oscillation stroke. The oscillation frequency is preferably between 3 Hz and 4 Hz, the oscillation stroke in the region of a few millimeters. By contrast, the rotary drives are preferably designed as a three-phase drives.

The press unit 10 and the inking unit 13 of FIG. 1 represent a basic module which may be expanded by further components. Thus, FIGS. 2 to 5 show extensions of the arrangement according to FIG. 1 but which make use of the same basic principle according to the present invention. In order to avoid unnecessary repetitions, therefore the same reference symbols will be used below for the same subassemblies and only the details which distinguish the embodiments of FIGS. 2 to 5 from the embodiment of FIG. 1 will be discussed.

Figure 2:
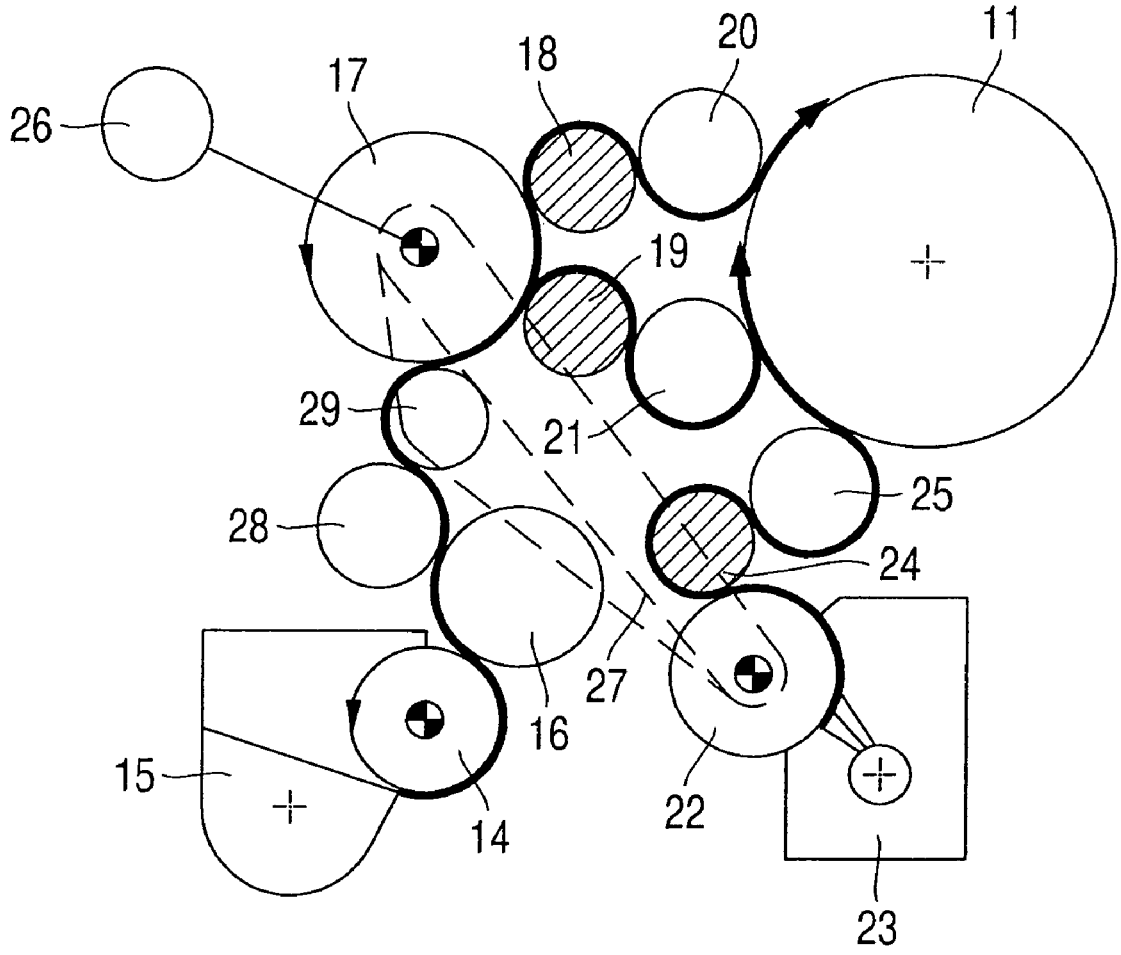
FIG. 2 is a schematic diagram of a region of a printing unit showing a press unit according to a second embodiment of the present invention.

In the embodiment of FIG. 2, two further inking unit rolls 28 and 29 are placed between the film roll 16 and the central rubber-covered roll 17. The inking unit roll 28 rolls on the film roll 16, and the inking unit roll 29 rolls on the central rubber-covered roll 17. The inking unit roll 28 is a relatively soft inking unit roll, the roll 29 is, by contrast, a relatively hard inking unit roll. As a result of the arrangement of the rolls 28 and 29 between the film roll 16 and the central rubber-covered roll 17, the application of ink to the forme cylinder 11 is optimized.

Figure 3:
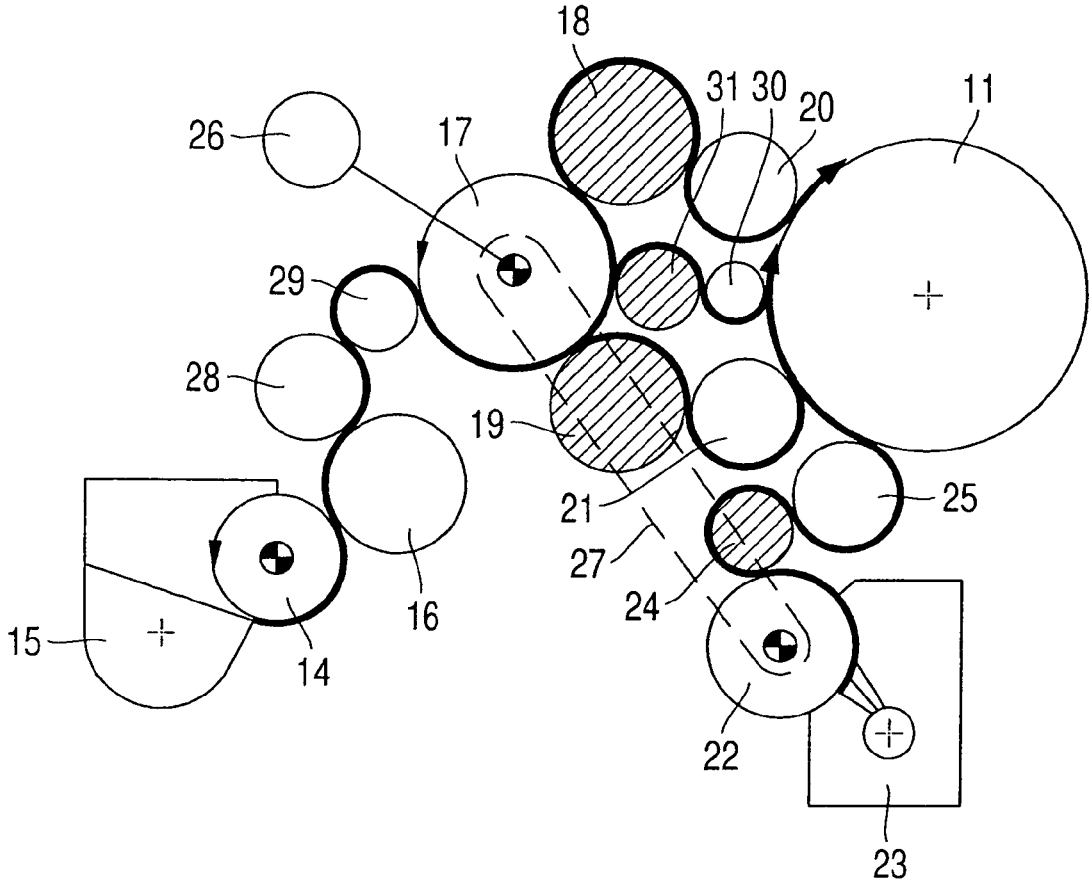
FIG. 3 is a schematic diagram of a region of a printing unit showing a press unit according to a third embodiment of the present invention.

In the embodiment of FIG. 3, the central rubber-covered roll 17 is followed not just by two inking roll trains but three instead, so that the printing ink is applied to the forme cylinder 11 via an additional ink applicator roll 30. Between the ink applicator roll 30 and the central rubber-covered roll 17, an inking unit roll 31, which carries out an oscillating movement, is also provided for the third inking roll train.

Figure 4:
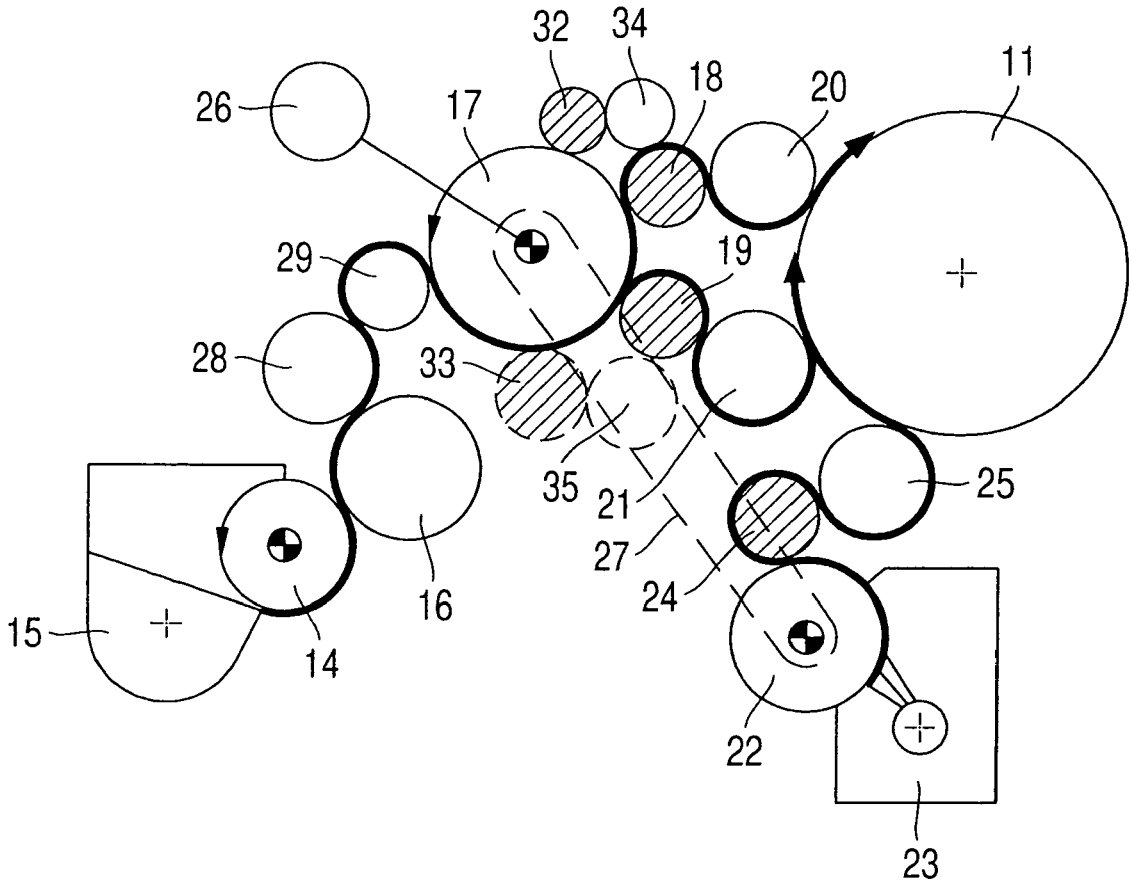
FIG. 4 is a schematic diagram of a region of a printing unit showing a press unit according to a fourth embodiment of the present invention.

In the embodiment of FIG. 4, further inking unit rolls 32, 33, 34 and 35 interact with the oscillating inking unit rolls 18 and 19, the inking unit rolls 32 and 33 being constructed as oscillating rolls and rolling on the central rubber-covered roll 17, and the inking unit rolls 34 and 35 each interacting with two oscillating inking unit rolls 18 and 32 and, respectively, rolls 19 and 33.

Figure 5:
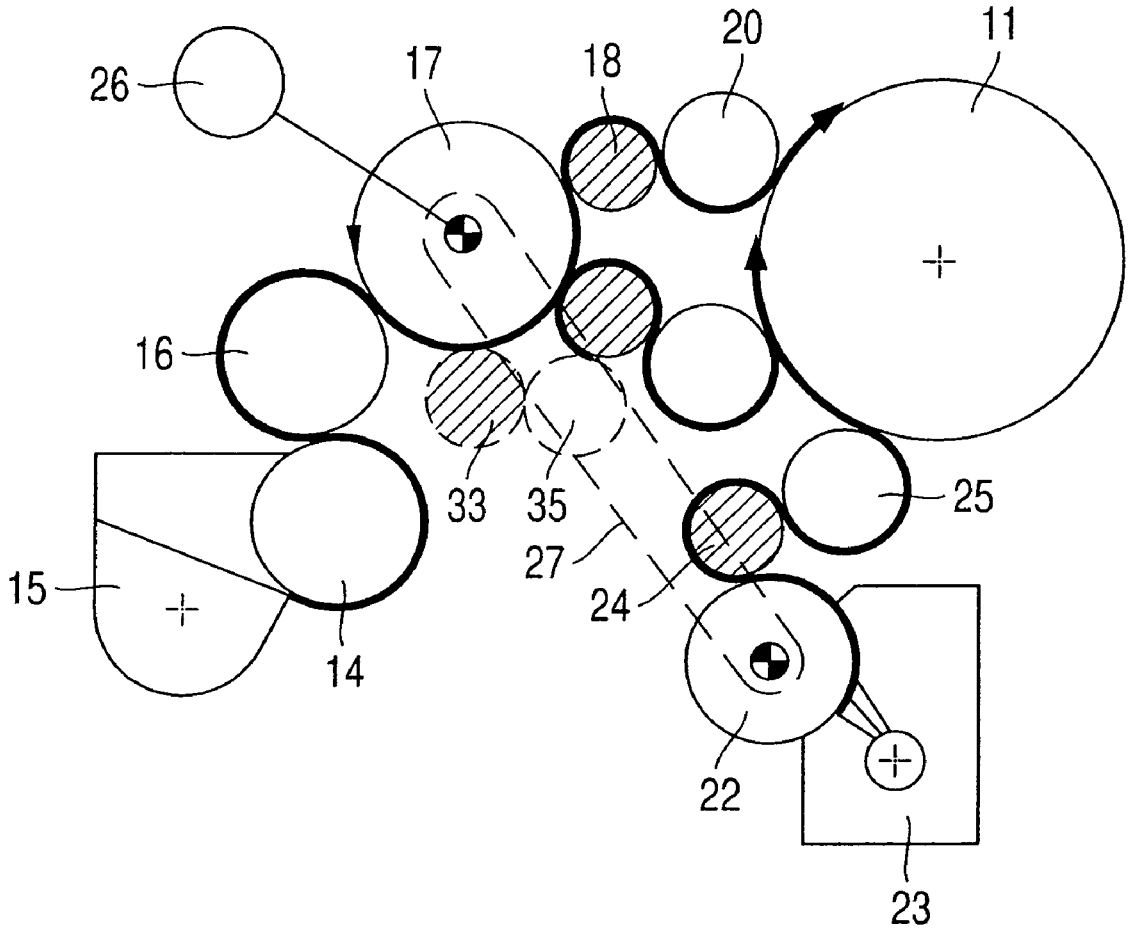
FIG. 5 is a schematic diagram of a region of a printing unit showing a press unit according to a further embodiment of the present invention.

FIG. 5 shows an extension of the invention which, again, comes closest to the arrangement of FIG. 1 and in which the inking unit rolls 33 and 35 interact with only one of the two oscillating inking unit rolls 19.

The rotary drives of the rolls driven in rotation and the axial drives of the rolls driven in oscillation of inking unit and damping unit are preferably constructed as individual motor drives. The rolls driven in rotation and the rolls driven in oscillation of inking unit and, if appropriate, damping unit can also each be driven by gear trains.

In addition to the extensions shown in FIGS. 2 to 5, further combinations of these extensions which make use of the basic principle according to the present invention may also be imagined. Furthermore, the present invention may also be used in press units which do not comprise a damping unit.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing unit having at least one press unit, each of the at least one press unit comprising:

a forme cylinder;

a transfer cylinder;

a damping unit arranged and dimensioned for applying damping solution to said forme cylinder, said damping unit including a chromium-coated or ceramic-coated roll arranged and dimensioned for picking up damping solution from a damping solution supply, and two rolls rolling on each other and positioned between said chromium-coated or ceramic-coated roll and said forme cylinder, said two rolls comprising a damping solution applicator roll in rolling contact with said forme cylinder and a roll in rolling contact with said chromium-coated or ceramic-coated roll;

an inking unit comprising an ink fountain, a doctor roll arranged and dimensioned for picking up printing ink from said ink fountain, a film roll, inking unit rolls, and at least one ink applicator roll, said doctor roll being arranged to transfer printing ink to said film roll, said film roll being arranged to transfer printing ink to said inking unit rolls, said inking unit rolls being arranged to transfer printing ink to said at least one ink applicator roll, and said at least one ink applicator roll being arranged to apply printing ink to said at least one forme cylinder, a rotary drive configured to rotatably drive a first inking unit roll of said inking unit rolls and an axial drive configured to drive a second inking unit roll of said inking unit rolls in oscillation, said second inking unit roll being in a rolling frictional connection at least with said first inking unit roll, wherein said rotary drive is decoupled from said axial drive such that said first inking unit roll is driven independently from said second inking unit roll and said second inking unit roll is rotatably driven only by said rolling frictional connection, and wherein said inking unit rolls comprise a central rubber-covered roll arranged downstream of said film roll, and at least two inking roll trains configured to transfer the printing ink from said central rubber-covered roll to said forme cylinder; and a toothed belt or chain drive which connects said central rubber-covered roll of said first inking unit and said chromium-coated or ceramic coated roll of said damping unit such that said central rubber-covered roll of said inking unit and said chromium-coated or ceramic-coated roll of said damping unit of the same press unit are driven in common by said rotary drive.

2. A printing unit having at least one press unit, each of the at least one press unit comprising:

a forme cylinder;

a transfer cylinder;

a damping unit arranged and dimensioned for applying damping solution to said forme cylinder, said damping unit including a chromium-coated or ceramic-coated roll arranged and dimensioned for picking up damping solution from a damping solution supply, and two rolls rolling on each other and positioned between said chromium-coated or ceramic-coated roll and said forme cylinder, said two rolls comprising a damping solution applicator roll in rolling contact with said forme cylinder and a roll in rolling contact with said chromium-coated or ceramic-coated roll; and an inking unit comprising an ink fountain, a doctor roll arranged and dimensioned for picking up printing ink from said ink fountain, a film roll, inking unit rolls including a central rubber-covered roll, and at least one ink applicator roll, said doctor roll transferring printing ink to said film roll, said film roll transferring printing ink to said inking unit rolls including said central rubber-covered roll, said central rubber-covered roll driven in rotation and transferring printing ink to at least two inking roll trains including said at least one ink applicator roll for transferring the printing ink from said central rubber-covered roll to said forme cylinder, wherein at least one inking unit roll of said inking unit rolls is driven in rotation and at least another inking unit roll of said inking unit rolls is driven in oscillation, said at least one inking unit roll being driven independently from said at least another inking unit roll; and said central rubber-covered roll of said inking unit and said chromium-coated or ceramic-coated roll of said damping unit of the same press unit are driven by a common rotary drive, said printing unit further comprising a toothed belt or chain drive connecting said central rubber-covered roll of said inking unit and said chromium-coated or ceramic-coated roll of said damping unit.

* * * * *